US005103186A

United States Patent [19]

Keinigs

[11] Patent Number: 5,103,186

[45] Date of Patent: Apr. 7, 1992

[54] TANDEM BETATRON

[75] Inventor: Rhonald K. Keinigs, Santa Fe, N. Mex.

[73] Assignee: United States Depaartment of Energy, Washington, D.C.

[21] Appl. No.: 643,315

[22] Filed: Jan. 22, 1991

[51] Int. Cl.[5] ..... H05H 11/00

[52] U.S. Cl. ..... 328/237; 328/233

[58] Field of Search ..... 313/62; 328/237, 233

[56] References Cited

U.S. PATENT DOCUMENTS

| | | | |
|---|---|---|---|
| 2,697,167 | 12/1954 | Kerst | 328/237 |
| 2,839,680 | 6/1958 | Wideroe | 328/237 |
| 4,481,475 | 11/1974 | Kapetanakos et al. | 328/237 |
| 4,577,156 | 3/1986 | Kerst | 328/237 |

OTHER PUBLICATIONS

M. Stanley Livingston et al., "The Betatron-Magnetic Induction Accelerator", *Particle Accelerators*, pp. 193-235, McGraw-Hill Book Company, New York, 1962.

*Primary Examiner*—Donald J. Yusko
*Assistant Examiner*—Ashok Patel
*Attorney, Agent, or Firm*—Ray G. Wilson; Paul D. Gaetjens; William R. Moser

[57] ABSTRACT

Two betatrons are provided in tandem for alternately accelerating an electron beam to avoid the single flux swing limitation of conventional betatrons and to accelerate the electron beam to high energies. The electron beam is accelerated in a first betatron during a period of increasing magnetic flux. The eletron beam is extracted from the first betatron as a peak magnetic flux is reached and then injected into a second betatron at a time of minimum magnetic flux in the second betatron. The cycle may be repeated until the desired electron beam energy is obtained. In one embodiment, the second betatron is axially offset from the first betatron to provide for electron beam injection directly at the axial location of the beam orbit in the second betatron.

9 Claims, 3 Drawing Sheets

Fig. 1
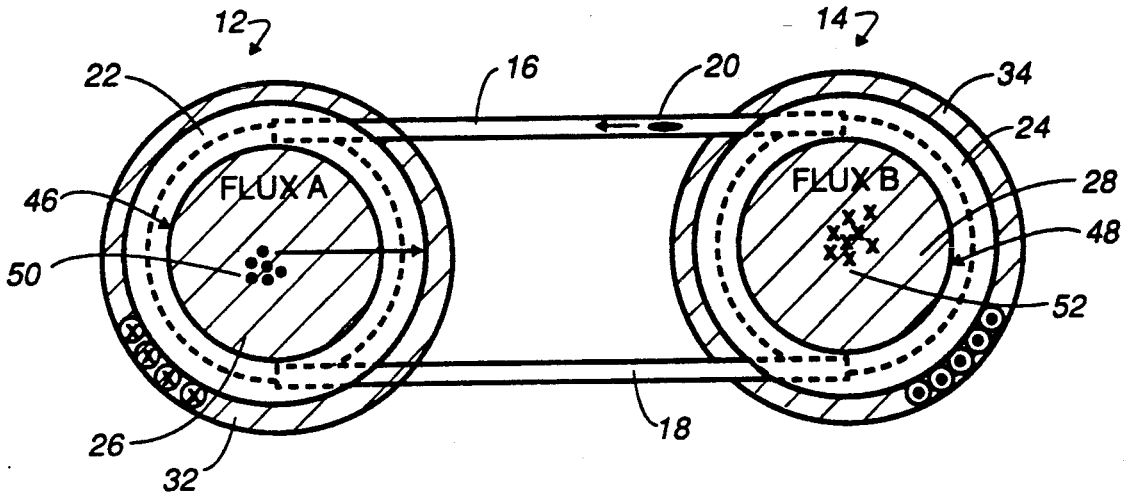
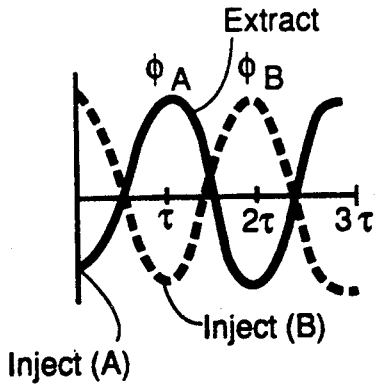
Fig. 4A
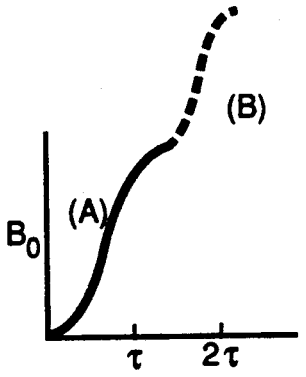
Fig. 4B

TANDEM BETATRON

This invention relates to electron accelerators and, more particularly, to magnetic induction betatron accelerators. This invention is the result of a contract with the Department of Energy (Contract No. W-7405-ENG-36).

BACKGROUND OF INVENTION

In magnetic induction betatron accelerators ("betatrons"), electrons are accelerated by an electric field induced by a changing magnetic flux linking the orbit of electrons in a circular path around the magnetic flux. The energy gained by an electron in one revolution about the flux is equivalent to the induced voltage in a one-turn coil having the electron orbit dimensions. Since electron velocities are large, approaching the speed of light at a few Mev, the electrons make many revolutions in a short time and acquire a high energy.

The general theory of betatrons is well known. See, e.g., M. Stanley Livingston et al., "The Betatron—Magnetic Induction Accelerator," *Particle Accelerators,* McGraw-Hill Book Company (1962); U.S. Pat. No. 2,697,167, "Induction Accelerator," issued Dec. 14, 1954, to Kerst; U.S. Pat. No. 4,577,156, "Push-Pull Betatron Pair," issued Mar. 18, 1986, to Kerst. All of these references are incorporated herein by reference.

Acceleration of the electrons is obtained from the changing magnetic field in a magnetic core about which the electron orbits. An increasing flux field provides the electric field necessary for electron acceleration. However, the maximum magnetic field change that can be obtained is the difference between a minimum field and a maximum field, generally defined by a sinusoidal wave shape. The energetic electrons must be removed before the magnetic flux begins to decrease and a decelerating electrical field is produced. All known prior betatrons have been constrained by this flux swing limitation, where the maximum energy gain can be shown to be $$\Delta E \leqq E_{max}(\text{MeV}) \approx 300 R_c B_s, \quad (1)$$

where E is the electron energy, $B_s$ is the core saturation flux field in Tesla and $R_c$ is the radius of the magnetic core in meters.

It is seen from the above equation that any electron energy increase is generally proportional to $R_c$, since $B_s$ is an intrinsic property of the material selected for the magnetic core. However, the mass of the magnet system (core plus return yoke) is a function of $R_c^3$, and this mass becomes prohibitively large for high energy betatrons.

This and other problems of the prior art are addressed by the present invention wherein two betatrons are provided in tandem to enable multiple flux swings to be used to accelerate electrons to high energies. Accordingly, it is an object of the present invention to eliminate the flux swing limitation on electron acceleration in magnetic induction accelerators.

Another object of the present invention is to provide betatrons having reduced magnetic core mass with an equal energy output as conventional betatrons.

One other object of the present invention is to remove electron energy output from being proportional to the radius of the betatron core in order to minimize the magnet mass needed for a given electron energy output.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF INVENTION

To achieve the foregoing and other objects, and in accordance with the purposes of the present invention, as embodied and broadly described herein, the apparatus of this invention may comprise a magnetic induction accelerator for accelerating electrons in a beam during a magnetic flux cycle linking the orbit of the beam around the magnetic flux. First and second betatrons are connected by an electron beam transport means effective to extract the electron beam from the first betatron and inject the beam into the second betatron.

In one embodiment of the accelerator the second betatron is displaced from the first betatron a distance effective to inject the electron beam directly at the elevation of the electron beam orbit in the second betatron. The magnetic flux cycles in the two betatrons are 180° out of phase so that the electron beam can be extracted from the maximum flux point of the first betatron cycle and injected at the minimum flux point of the second betatron cycle.

In another characterization of the present invention, a method is provided for accelerating an electron beam in a magnetic induction accelerator having an accelerating electric field generated during a magnetic flux cycle linking the orbit of the electron beam in a circular path around the magnetic flux. The electron beam is accelerated in a first betatron during a period of increasing flux in said magnetic flux cycle in the first betatron. The electron beam is extracted from the first betatron at a predetermined time in the magnetic flux cycle and injected into a second betatron at the beginning of a period of increasing flux in the magnetic flux cycle in the second betatron. The electron beam may be alternately transported between the first and second betatrons for increasing beam energy to a selected value.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings:

FIG. 1 is a pictorial illustration in plan view of a tandem betatron according to one embodiment of the present invention.

FIGS. 4A and 4B graphically illustrate the timing and relative magnitudes of the magnet fluxes and confining magnetic fields for the electron beam.

DETAILED DESCRIPTION OF THE DRAWINGS

A tandem betatron (TB) is a compact, high-current induction accelerator that has the capability to accelerate electrons to an energy on the order of one gigavolt. Based on the operating principle of a conventional betatron, the tandem betatron employs two synchronized induction cores operating 180 degrees out of phase. Embedded within the cores are vacuum chambers for accelerating an electron beam (e-beam), and these are connected by linear transport sections to allow for moving the beam back and forth between the two betatrons. The 180 degree phase shift between the core fluxes circumvents the flux swing constraint that limits the maximum energy gain of a conventional betatron.

By transporting the beam between the synchronized cores, an electron can access more than one acceleration cycle, and thereby continue to gain energy. This energy gain method provides greater flexibility in accelerator design, with increased e-beam energies available from greatly reduced core sizes. Biasing coils provide independent control of the confining magnetic field. At an energy of one gigavolt, a high current electron beam circulating in a one meter radius orbit could provide a very intense source of short wavelength ($\lambda < 10$ nm) synchrotron radiation for direct application to the emerging field of x-ray lithography. At more modest energies (10 MeV–30 MeV) a compact TB would be useful in the fields of medical radiation therapy, industrial radiography, and materials processing.

Figure 2:
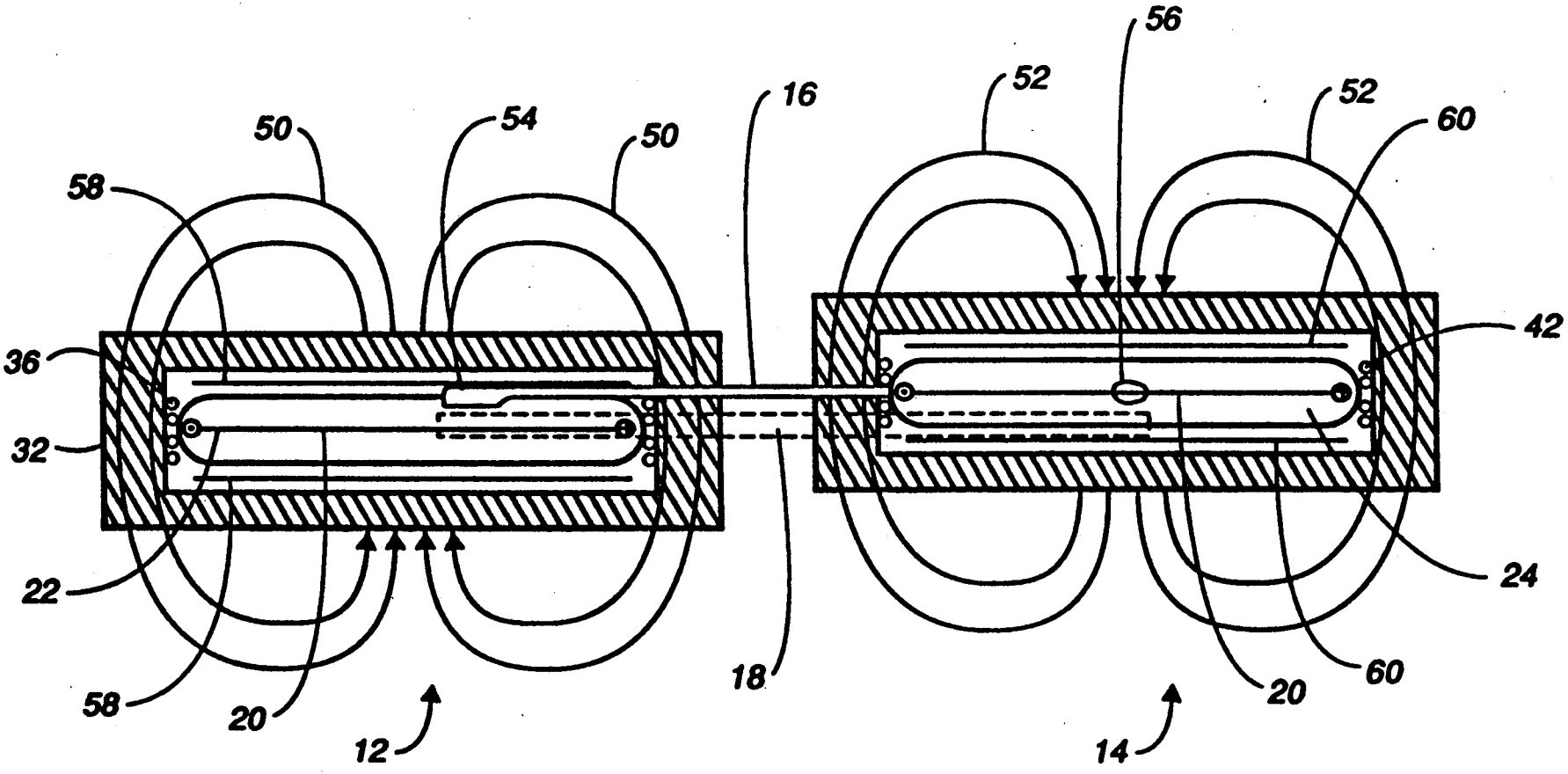
FIG. 2 is a pictorial illustration in cross-section of the tandem betatron shown in FIG. 1.

Referring first to FIGS. 1 and 2, pictorial schematics of a TB are shown in plan view and cross-sectional view, respectively. The operation of a TB is similar to that of a conventional betatron, but the TB is two betatrons 12. 14, each with a ferromagnetic core 26, 28 and flux return yoke 32, 34, respectively, driven 180 degrees out of phase through flux coils 46, 48. For a discussion of flux coil operation see, e.g., Livingston supra, FIGS. 7–10 at page 208 and the '156 Kerst patent. Flux coils 46 and 48 produce flux fields 50 and 52, respectively, for generating electric fields to accelerate electrons 20. Vacuum chambers 22, 24, in which the electrons 20 are alternately accelerated, are embedded within the cores 26, 28 and connected by linear transport sections 16. 18. By staging the two betatrons 12, 14 in this manner, an electron beam 20 can access more than one acceleration cycle by being shuttled back and forth between the two cores.

Beam confinement is maintained by using an independent set of field biasing coils 36 and 42 to control the magnitude of the confining magnetic fields in vacuum chambers 22, 24, respectively. The confining field must continue to increase along with the increasing beam energy. Efficient beam transport requires monitoring the changing flux in the cores and, at the proper time, extracting e-beam 20 from vacuum chamber 22 and injecting e-beam 20 into vacuum chamber 24. This may be done by energizing electrostatic lifters 58, 60 to lift the beam into a magnetic field-free region created by conventional beam peelers, where it can be guided into linear transport sections 16, 18. By vertically offsetting vacuum chambers 22, 24 with respect to one another, as shown in FIG. 2, the lifted beam is reinjected "straight" into the complimentary betatron to eliminate any need for recentering the beam.

Figure 3:
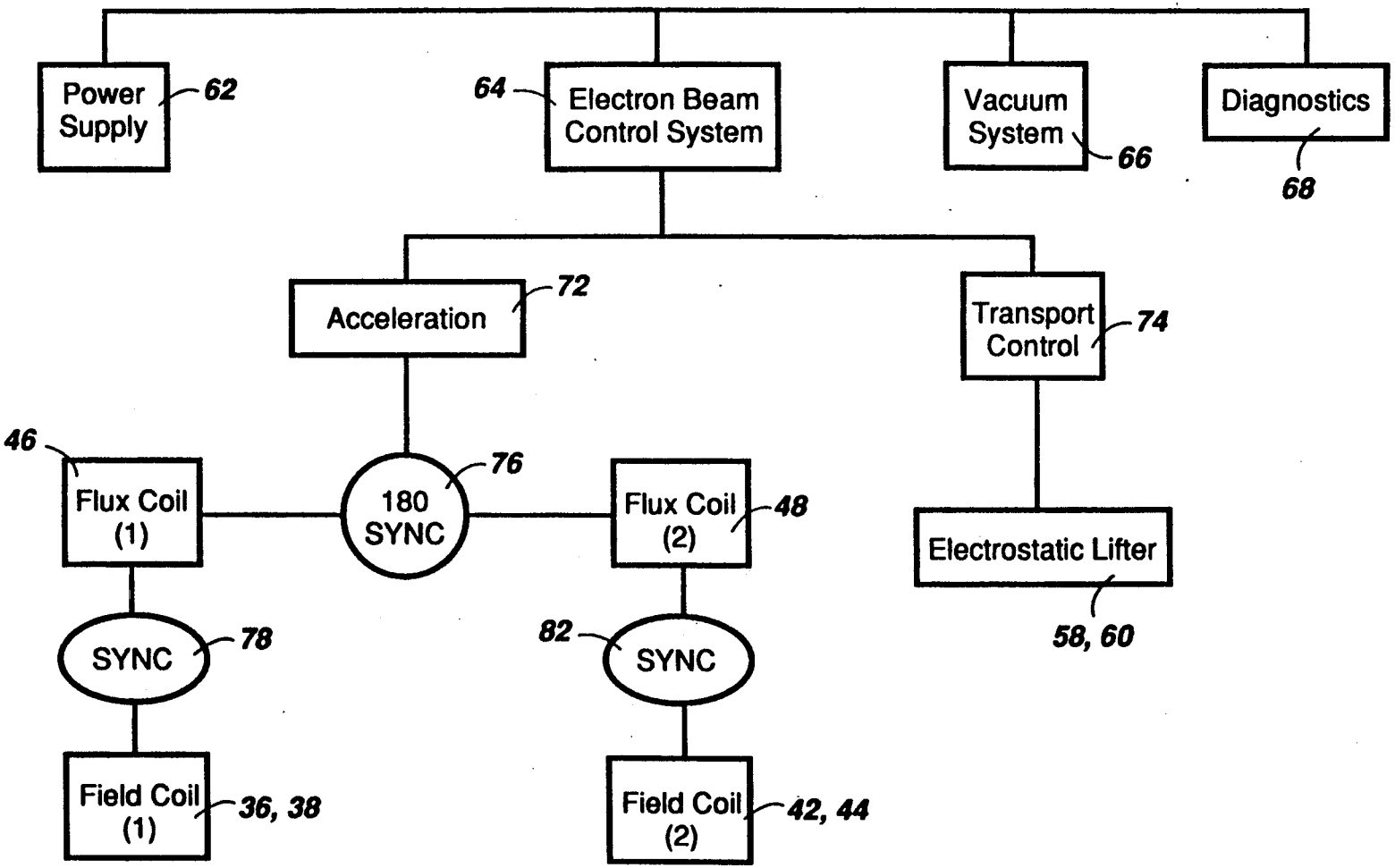
FIG. 3 is a schematic diagram in block diagram form of a power and control system for the tandem betatron shown in FIG. 1.

FIG. 3 depicts in block diagram form a power and control system for the TB. Power supply 62 is output to electron beam power and control system 64, vacuum system 66 for maintaining a vacuum in the e-beam acceleration and transport tubes, and diagnostic elements 68 for standard system monitoring. Electron beam control system 64 further outputs power and control signals to the acceleration control system 72 and the transport control system 74.

Acceleration control system 72 provides power and control signals to flux coil 46 and flux coil 48, as shown in FIGS. 1 and 2. Synchronizer 76 synchronizes power output to coil 46 and coil 48 to produce flux A in core 26 and flux B in core 28 that are 180° out of phase, as shown in FIG. 4A. Synchronizers 78, 82 monitor the energy of the e-beam and provide output power and control to field coils 36 and 42 for maintaining a confining magnetic field for the e-beam as the energy increases.

The general configuration of the field coil outputs is shown in FIG. 4B, indicating the increasing confining field needed for higher energy beams. FIG. 4A also shows that a beam is accelerated during a cycle of flux A 50 for a period ($\tau$), extracted at the peak flux and injected at a minimum of flux B 52 for further acceleration. The confining field is ever increasing for each beam swing, where the equilibrium field $B_o(t)$ must satisfy "tandem" betatron condition, $$B_o(t)=(1/2\pi R^2)\{\Delta^N\phi+(N-1)\Delta\phi(\tau_p)\}, \quad (2)$$

where $\Delta^N\phi$ is the flux change of the appropriate core on the $N^{th}$ swing, $\Delta\phi(\tau_p)$ is the maximum flux swing of a core, and R is the radius of an electron's orbit. It is noted that on the first swing, $N=1$, and the equation reduces to the well known "2:1 rule" for orbit equilibrium.

The TB eliminates the flux swing constraint that limits the maximum energy gain of a single core device. The upper bound on the beam energy is, thus, determined by synchrotron radiation losses. For a small radius orbit (R$\delta$1m), the relative synchrotron losses can be negligible, even at energies as high as one gigavolt, provided that a sufficiently fast flux swing is employed. Recently developed metallic glasses having very high saturation fields and fast response times can yield sufficiently high acceleration gradients to overcome radiation losses.

The TB offers significant advantages in energy gain and core mass scaling. As in a conventional betatron, the energy gained during one acceleration cycle can be expressed as $$\Delta E(MeV)=30\cdot F\cdot R_c(m)B_s(kG), \quad (3)$$

where F defines that fraction of the flux swing that is actually accessed, typically about 0.7. An increase in the energy gain is thus directly proportional to the core radius, $R_c$, and scales as $$\Delta E_c \alpha M_c^{1/3} \quad (4)$$

This equation indicates that doubling the beam energy requires increasing the magnet mass eight-fold. This means that a high energy, conventional betatron is impractical, and indeed the largest conventional betatron has an output energy of only 300 MeV (Livingston, supra).

By providing flux swings in the two cores that are 180° out of phase, the energy gained by an electron that as accessed N cycles is $$\Delta E_T = N \cdot \Delta E, \quad (5)$$

where ΔE is given by Equation (3). A mass ratio for the two accelerators can be expressed in terms of the number of completed acceleration cycles and the energy ratio:

$$M_T/M_C = (2/N^3)(\Delta E_T/\Delta E_C). \quad (6)$$

Subscripts C and T refer to conventional and tandem betatrons, respectively. According to this relationship, a significant reduction in mass can be achieved by employing two cores to provide acceleration for the beam. For example, consider the case where $\Delta E_T = \Delta E_C$. Then the relationship indicates that a TB having only one quarter of the mass of a CB can produce the same beam energy after two acceleration cycles. Completing three cycles would enable either a 93% reduction in mass, or a higher beam energy. For equal mass accelerators, $$\Delta E_T = [N/(2^{1/3})]\Delta E_C. \quad (7)$$

Power losses for a TB are reduced by employing two cores having smaller volume than that of an equivalent energy CB. Reducing the volume decreases the amount of heat that is generated in the magnet by eddy currents. Power losses can be further minimized by utilizing a core material having a narrow hysteresis loop.

Elimination of the flux swing constraint means that the maximum energy of a TB is intrinsically limited only by synchrotron losses. For high power TB's, i.e., a one gigavolt accelerator, attention must be paid to the type of magnets used. The cores must have a high saturation field in order to provide for a large energy gain on each pass and to minimize the number of acceleration cycles. The magnets must have the capability of being pulsed on a short time scale in order to obtain an accelerating gradient high enough to compensate for synchrotron losses. Metglas is an amorphous ferromagnetic alloy that produces saturation fields as high as 16 kG and can be pulsed as fast as 50 ns. At high frequencies, where transformer core losses are dominated by eddy current heating, the relatively high volume restivity of Metglas minimizes the power losses. The material is sufficiently flexible to wrap into cores in very thin ribbons.

Referring again to FIG. 2, electrostatic lifters 58. 60, beam peeler 54, transport tubes 16, 18, and injection port 56 may be used for cycling a high energy e-beam between betatrons 12, 14. It is noted that a high beam extraction efficiency is required after each acceleration cycle in order to maintain an appreciable beam current. For example, an extraction efficiency of 80% will yield a beam current that is half the original injected beam current after three cycles. The axial offset of vacuum chambers 22, 24 simplifies beam extraction and injection. Rf bunching may be further used to increase extraction efficiency.

To provide an axial extraction capability, electrostatic lifters 58 60 are used to lift beam 20 into a magnetic field-free region provided by peeler 54 in the septum at the entrance of transport tube 16. Electrostatic lifters 58, 60 generally parallel the electron orbit to provide a pulsed electrostatic field traveling with the electrons to lift electron beam 20 as the maximum flux value is approached. The application of the field is synchronized with the flux field for e-beam extraction. Peeler 54 may be a conventional magnetic peeler using a laminated iron channel to provide a region of little or no magnetic field in the channel so that the momentum of the electrons will cause the e-beam to continue tangentially into the transport tubes.

It is anticipated that e-beam 20 will be shifted into exit port/peeler 54 in only a single orbit using a pulsed transverse electric field produced by electrostatic lifters 58, but several orbits may be used for high energy e-beams. The voltage $V_o$ required across electrostatic lifters 58, 60 can be shown to be $$V_o \delta (0.05/N^2)(H/R)(z/R)(E_b/e), \quad (8)$$

where N is the number of orbits over which beam 20 is lifted, H is the separation between electrostatic field conductors, R is the electron orbit radius, z is the distance an electron is lifted by a single pulse, and $E_b$ is the e-beam energy. Then, for example, for $E_b/e = 300$ MeV, H=0.1 m, z=0.05 m, R=1 m, the resulting voltage is $V_o = 75$ kV for a single orbit extraction. For a multi-orbit extraction, smaller voltage pulses are required; e.g., lifting the beam 0.04 m in four orbits with a final 0.01 m extraction lift in one orbit would require voltage pulses of 3.75 kV with an extraction pulse of 7.5 kV.

Each transport tube 16, 18 will incorporate one exit port/peeler 54 and one injection port 56. The injection port 54 is axially aligned at the elevation of the e-beam 20 orbit. For beam extraction, the pulsed electric field travels around the ring on transmission line structures 58, 60 at the speed of light. The pulsed voltage has a fast rise-time compared with the beam 20 circulation period and a good flat top. The pulsed electric field and beam momentum move the beam outside the septum at exit port 54 for transport and injection into the complimentary betatron.

For moderate energy beams, i.e., beams of 10–30 MeV, a conventional radial extraction might be used. The magnetic field 50, 52 produced by the field coils 36, 42 is decreased to increase the orbit radius of beam 20 as a peak flux A or B, respectively, is approached. Beam 20 expands to interact with a beam peeler whereby the beam momentum will carry electrons into a transport tube 16, 18 for injection into the adjacent betatron. The output of the field coils 36, 42 is then synchronized at injection to increase the field strength for compressing beam 20 orbit to an equilibrium orbit. For radial extraction, betatrons 12, 14 are axially aligned.

Thus, the TB obtains many advantages over conventional betatrons that can use only one flux swing:

(1) Energy regimes higher than those that can be reached with a conventional betatron become accessible.

(2) A very significant reduction in the mass of the magnet system can be achieved, particularly in regimes of moderate energy, 10 MeV–100 MeV.

(3) A reduction in the size of the magnets translates into reduced power losses.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A magnetic induction accelerator for accelerating electrons in an electron beam during a magnetic flux cycle linking an electron beam orbit around a magnetic flux, comprising:

a first betatron;

a second betatron adjacent said first betatron; and electron beam transport means for extracting said electron beam from said first betatron and injecting said electron beam into said second betatron.

2. An accelerator according to claim 1, further including acceleration control means for generating a magnetic flux cycle in said second betatron 180° out of phase with a magnetic flux cycle in said first betatron.

3. An accelerator according to claim 2, wherein said electron beam transport means further includes transport control means for extracting said electron beam at a maximum of said magnetic flux cycle in said first betatron and injecting said electron beam at a minimum of said magnetic flux cycle in said second betatron.

4. An accelerator according to claim 1, wherein said second betatron is axially offset from said first betatron a distance effective to inject said electron beam directly at an elevation of said beam orbit in said second betatron.

5. An accelerator according to claim 2, wherein said second betatron is axially offset from said first betatron a distance effective to inject said electron beam directly at an elevation of said beam orbit in said second betatron.

6. An accelerator according to claim 3, wherein said second betatron is axially offset from said first betatron a distance effective to inject said electron beam directly at an elevation of said beam orbit in said second betatron.

7. A method for accelerating an electron beam in a magnetic induction accelerator having an accelerating electric field generated during a magnetic flux cycle linking an electron beam orbit in a circular path around a magnetic flux, comprising the steps of:

accelerating said electron beam in a first betatron during a period of increasing flux in a magnetic flux cycle in said first betatron;

extracting said electron beam from said first betatron at a predetermined time in said magnetic flux cycle of said first betatron; and injecting said electron beam into a second betatron at the beginning of a period of increasing flux in a magnetic flux cycle in said second betatron.

8. A method for accelerating an electron beam according to claim 7, further including a step of synchronizing said magnetic flux cycles in said first and second betatrons to be 180° out of phase.

9. A method according to claim 8, further including a step of alternately transporting said electron beam between said first and second betatrons until a selected beam energy is obtained.

* * * * *